US011279456B2

(12) United States Patent
Cotter

(10) Patent No.: US 11,279,456 B2
(45) Date of Patent: Mar. 22, 2022

(54) OAR FEATURING MEASUREMENT SLEEVE AND RELATED METHODS

(71) Applicant: Ray Cotter, Laurel, MT (US)

(72) Inventor: Ray Cotter, Laurel, MT (US)

( * ) Notice: Subject to any disclaimer, the term of this patent is extended or adjusted under 35 U.S.C. 154(b) by 143 days.

(21) Appl. No.: 16/871,007

(22) Filed: May 10, 2020

(65) Prior Publication Data

US 2020/0354034 A1 Nov. 12, 2020

Related U.S. Application Data

(60) Provisional application No. 62/846,380, filed on May 10, 2019.

(51) Int. Cl.
*B63H 16/04* (2006.01)

(52) U.S. Cl.
CPC ..... *B63H 16/04* (2013.01); *B63H 2016/043* (2013.01)

(58) Field of Classification Search
CPC ..... B63H 16/04; B63H 2016/043
See application file for complete search history.

(56) References Cited

U.S. PATENT DOCUMENTS

| | | | | |
|---|---|---|---|---|
| 1,383,559 A * | 7/1921 | Alfredn | B63H 16/04 440/36 |
| 8,051,789 B1 * | 11/2011 | Tylisz | B63B 21/22 114/230.1 |
| 2009/0211142 A1 * | 8/2009 | Sackett | A01K 97/10 43/21.2 |
| 2020/0354034 A1 * | 11/2020 | Cotter | B63H 16/04 |

* cited by examiner

*Primary Examiner* — S. Joseph Morano
*Assistant Examiner* — Jovon E Hayes
(74) *Attorney, Agent, or Firm* — Timothy W. Fitzwilliam

(57) ABSTRACT

An accessory sleeve that fits over an oar combination is disclosed herein. The sleeve is configured with a ruler or a tape measure printed on a surface thereof. Further, the sleeve comprises neoprene that yields proper feel and grip while stretching slightly so that the sleeve can be easily applied and removed, if necessary. The ruler is supported underneath by a nylon strip that prevents shrinking initially and any stretching during the useful life of the sleeve.

13 Claims, 8 Drawing Sheets

OAR FEATURING MEASUREMENT SLEEVE AND RELATED METHODS

PRIORITY CLAIM

This patent application claims benefit of the priority date of U.S. Prov. Pat. App. Ser. No. 62/846,380 filed on May 10, 2019 entitled "Oar Measurement Sleeve." Accordingly, the entire content this U.S. provisional patent submission is hereby expressly incorporated by reference.

BACKGROUND OF THE INVENTION

Field of the Invention

The present invention pertains generally to accessories for watercraft and/or recreational fishing. More specifically, the present invention relates to a sleeve configured over an oar, the combination particularly useful for measuring the length of fish and providing physical documentation thereof.

Description of the Prior Art

Ever increasing in popularity, outdoor enthuiestes take to fishing our nation's lakes and rivers, as well as larger bodies of water at or near coastline. And, many sport fishermen and hobbyists alike are engaging in catch and release while not overly stressing the animal. In such cases, it is often desirable to measure the fish prior to its release for generally providing documentation and data to that particular catch.

Hence there is a need in the fishing market to provide a measurement and verification means for fish to document its length. There is also a present need or opportunity to provide decoration, brand recognition or advertising to a row device also well known as an oar. As is also known, an oar has a blade at a distal end and a handle at a proximal end. At a midsection toward the proximal end, an oar rope wrap may be included that contacts and pivots about an oar lock configured to a watercraft, for example, a raft, a dingy, a panga/skiff, or a fly-fishing drift boat. Further for this purpose, and oar stop is also known provided over the rope wrap. Additional novel configurations to the oar and steps documenting fish length are detailed herein.

BRIEF SUMMARY OF THE INVENTION

The present invention specifically addresses and alleviates the above mentioned deficiencies, more specifically, the present invention, in a first aspect, is an oar for manual propulsion of a watercraft, comprising: an elongated substantially cylindrical pole section; a blade configured at a distal end to the elongated cylindrical pole section; a handle configured at a proximal end; and a sleeve configured over the elongated cylindrical pole section, the sleeve comprising: a neoprene rubber substrate; and a print layer affixed to the neoprene rubber substrate; the print layer including a ruler having markings at evenly spaced intervals to measure length.

This invention in this first aspect is additionally characterized as further comprising: a rope wrap including a cord wrapped around the cylindrical elongated pole approximately at a an upper mid-section thereof closest to the proximal end, the rope wrap for contacting and pivoting about an oar lock, wherein further the sleeve is configured partially covering a portion of the rope wrap wherein further the sleeve has the portion covering the rope wrap and a portion covering the cylindrical pole section without the rope wrap.

Further in the first aspect, the invention comprises an oar stop configured over a surface of the rope wrap wherein the sleeve is configured extending along the length of the oar from a transition point between the handle and cylindrical pole section to the oar stop, the oar stop for preventing the oar from sliding entirely through an oar lock.

Yet still further in the first aspect, the the neoprene rubber substrate comprising a textured inner surface for contacting and gripping a surface of the oar during positioning or removal. Alternatively depending on the type of oar employed, the neoprene rubber substrate comprises a smooth inner surface for sliding over a surface of the oar during positioning or removal. Also in the first aspect, the sleeve has a hemline band configured at first and second ends thereof for contacting and gripping the oar while in a position of use.

In a second aspect the invention is an oar for assisting manual propulsion of a water craft comprising: a handle portion at a proximal end; a blade at a distal end; and a substantially cylindrical pole section, therebetween, the cylindrical pole section comprising: a rope wrap approximately at an upper mid-section of the pole section with respect to the proximal end, the rope wrap for interfacing and pivoting about an oar lock affixed to the water craft; and a neoprene sleeve configured partially over the rope wrap between the handle and the oar stop, the neoprene sleeve having a ruler printed on a surface thereof for measuring a length of a fish.

Yet still in the second aspect, the invention the neoprene sleeve further comprises: a neoprene substrate; and a print layer affixed at an outer surface of the neoprene substrate, the print layer including a sublimation layer combined to a polyester layer via a heating process, the sublimation layer further comprising a printed image transferred to the polyester layer during said heating process.

Further in the second aspect, the neoprene sleeve further comprising an elongated nylon strip (e.g. having a ¾" width) sewn at an inner surface of the sleeve opposite the ruler, the nylon strip for preventing excessive shrinking or stretching during a manufacturing process, the preventing for ensuring ruler measurement accuracy. In a preferred embodiment using a specific type of oar, the substantially cylindrical pole section transitions to a squarish pole section with rounded corners as the pole section approaches the handle portion; the neoprene sleeve also includes a smooth, (e.g. black duo poly) neoprene for assisting in sliding the neoprene sleeve over the squarish pole section in removal or replacing the sleeve.

In a third aspect, the invention is an oar measurement sleeve configured to fit over an elongated pole section of the oar comprising: a neoprene rubber substrate having a length and a circumference; and a print layer heated to the neoprene rubber substrate; the print layer including a ruler having markings at evenly spaced intervals to measure length further wherein the circumference is approximately 6.5 inches, the 6.5 inches being appropriate for snuggly fitting over existing oars being between approximately 8 feet and 10 feet in length.

Further in a third aspect, the print layer comprises: a polyester layer epoxied to the neoprene substrate; and a gaseous sublimation layer having solidified subsequent to a heating process. An additional feature of the sleeve is that is has main seam along a length thereof, the main seam assisting in placing the sleeve aligned to the oar.

In still another fourth aspect, the invention is a method for determining and verifying a length of a fish comprising the steps of: providing an oar device having a blade on a distal end and a handle on a proximal end; providing a neoprene rubber cylindrical tubular sleeve; affixing a print layer on a top surface of the cylindrical sleeve; marking the print layer with a ruler comprising markings at evenly spaced intervals. In some embodiments, a sublimation layer is heated to a polyester layer for a predetermined temperature and for a predetermined time, forming the printed layer being permanently combined.

Additional method steps include configuring the cylindrical sleeve over the oar device between the blade and the handle; and measuring and determining a length of the fish with the ruler. Subsequent steps further include photographing the fish juxtaposed to the sleeve configured over the oar device; providing a digital photograph thereof, and uploading the digital photograph to a digital medium. Further in the method is the step of adorning the print layer with fishing guide information or fishing retail storefront name or fishing equipment brand. More steps are providing an oar stop approximately at an upper mid-section of the oar, the oar stop for preventing the oar from sliding entirely through an oar lock; and extending the sleeve from approximately the handle to the oar stop. Also important in the method is the accounting for a shrinking of the neoprene sleeve during a step of heating by providing a ruler that is larger before the heating, the ruler being accurate subsequent to the heating.

These, as well as other advantages of the present invention, will be more apparent from the following description and drawings. It is understood that changes in the specific structure shown and described may be made within the scope of the claims, without departing from the spirit of the invention.

While the apparatus and method has or will be described for the sake of grammatical fluidity with functional explanations, it is to be expressly understood that the claims, unless expressly formulated under 35 USC § 112, or similar applicable law, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC § 112 are to be accorded full statutory equivalents under 35 USC § 112, or similar applicable law. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF PREFERRED EMBODIMENTS

Figure 1A:
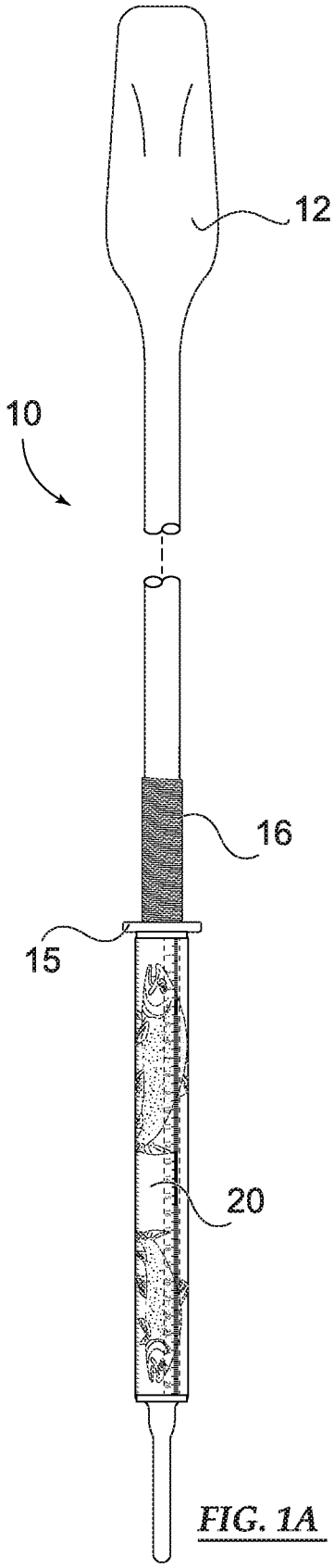
FIG. 1A and FIG. 1B are elevational views of an oar of the present having an accessory sleeve in a position of use.

Referring initially to FIG. 1A, an elevation view of an oar 10 featuring measurement sleeve representing a first embodiment of the present invention is shown. An elongated pole section 11 makes up the length of the oar 10 flanked by the oar's blade 12 and handle portion 13. The elongated pole section is cylindrical 11 or substantially cylindrical 91 as detailed herein. An oar stop 15 and rope wrap 16 are provided to the oar 10. The oar sleeve 20 is further provided extending downward from the oar stop 15 creating a more convenient fish measuring device designed to fit on 8' or longer (approximately 10') drift boat or raft oars. The sleeve 20 not only creates a convenient way to measure and document a fish, it also customizes the overall look of the boat oars 10, 90.

Figure 1B:
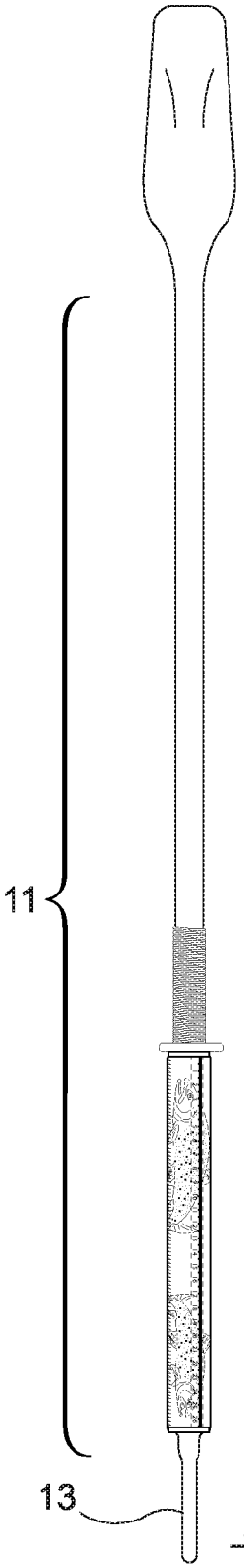

With regard to FIG. 1B, an elevation view of a 9' oar is drawn showing relative lengthwise dimensions including a sleeve fitted extending 26.5" and a handle portion being approximately 8". The rope wrap 16 includes a cord wrapped around the cylindrical elongated pole section 11 approximately at a (an upper) mid-section thereof closest to the proximal (handle 13) end. the rope wrap is provided for contacting and pivoting about an oar lock. Additionally further, the sleeve 20 is configured partially covering a portion of the rope wrap 16 wherein further the sleeve has the portion covering the rope wrap 16 and a portion covering the cylindrical pole section 11 without the rope wrap.

Figure 2:
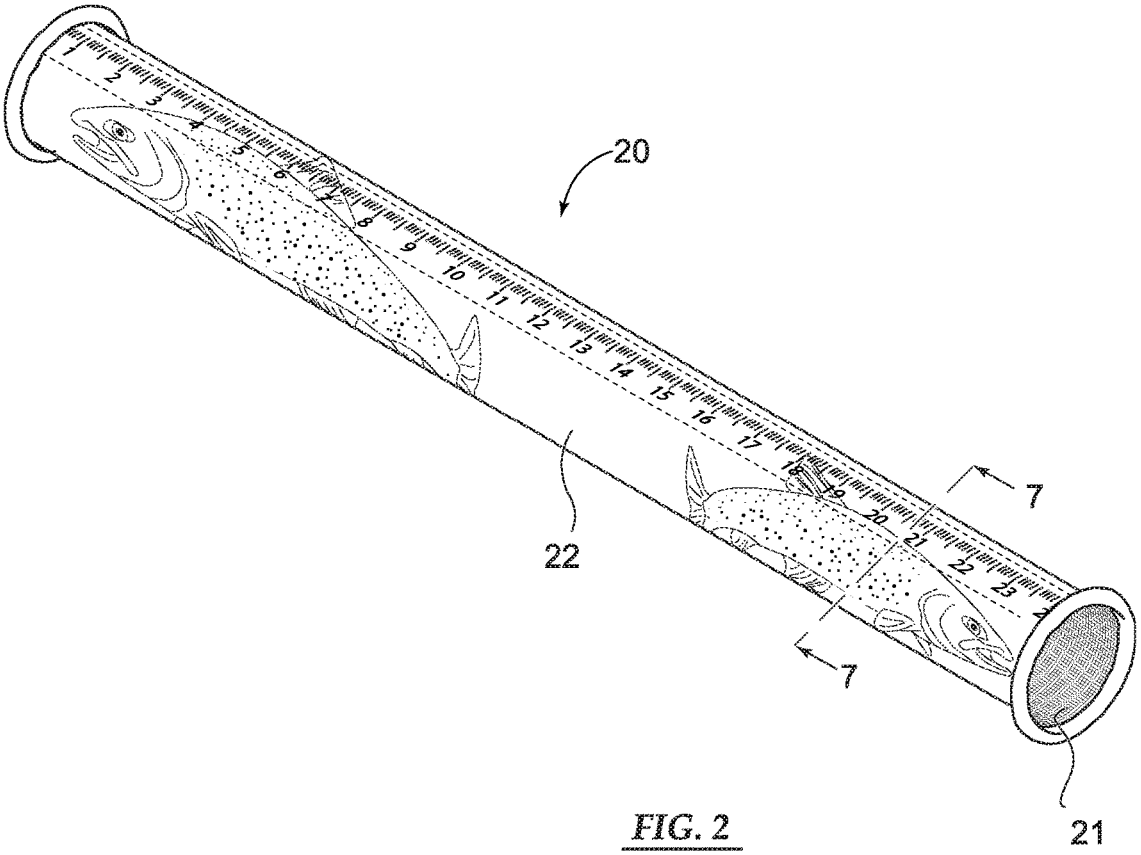
FIG. 2 is a perspective view of the measurement sleeve having a ruler printed on a surface thereof.

Now turning to FIG. 2, the measurement sleeve 20 having a ruler 26 printed on a surface 22 thereof is illustrated in perspective. As an example, the sleeve is aesthetically pleasing including rainbow or brown trout printed with vibrant colors. As detailed with regard to various embodiments herein, the sleeve comprises a neoprene rubber substrate 21 with a top print layer 22 affixed thereto.

Figure 3:
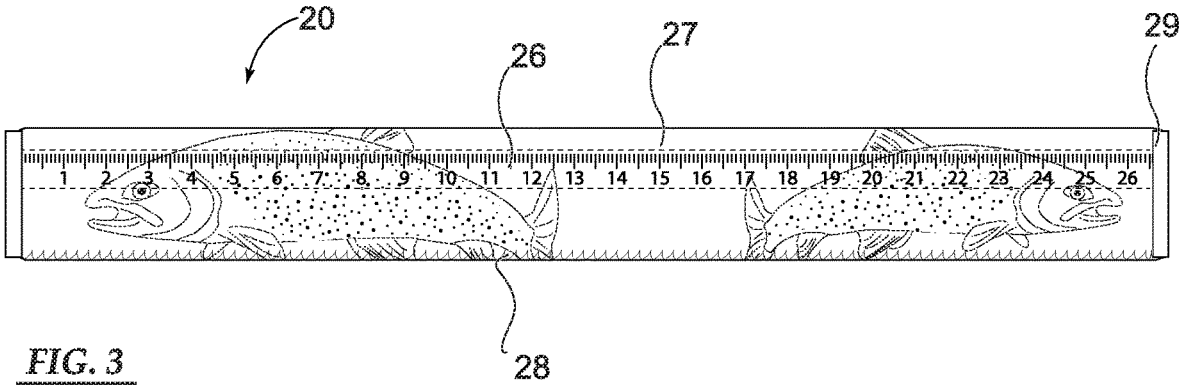
FIG. 3 is a profile view thereof.
Figure 4:
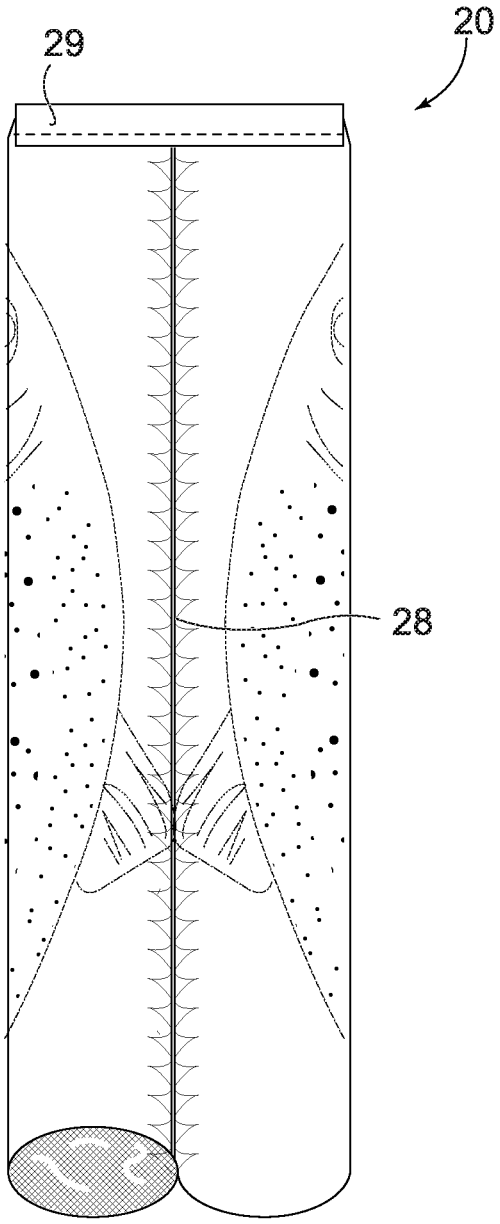
FIG. 4 and FIG. 5 are partial enlarged elevational views rotated with respect to one another.
Figure 5:
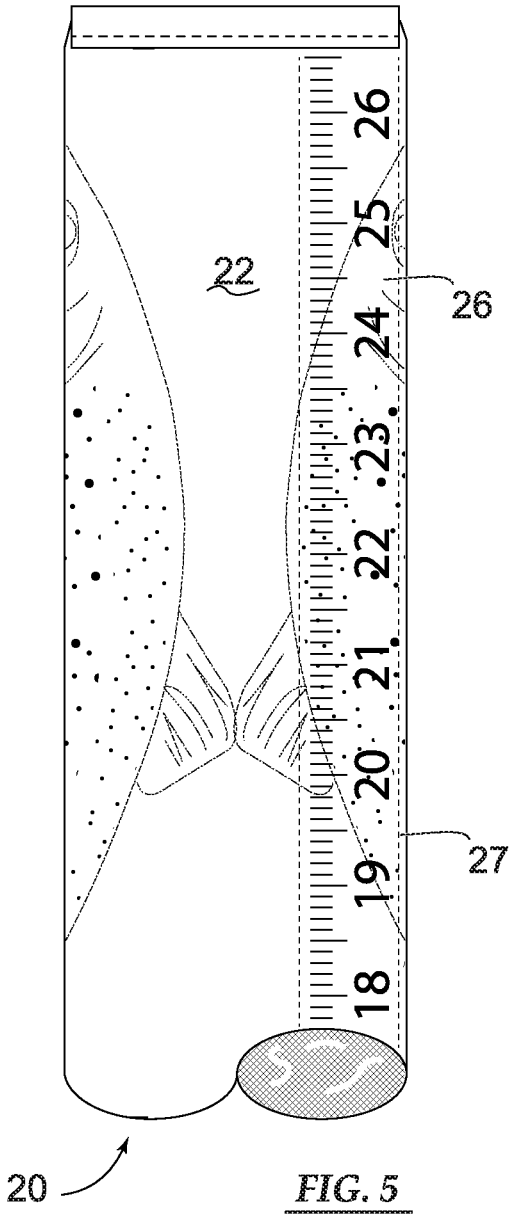

With regard to FIG. 3, a profile view is provided showing a main seam 28 opposite threads 27 on lateral borders of the ruler. The main seam joins ends of the polyester layer 22 forming a cylindrical sleeve. The ruler border threads secure a webbing layer 23 sewn directly underneath the ruler, as detailed herein. FIG. 4 and FIG. 5 show rotated views of the first sleeve embodiment. The ruler has evenly spaced marking to measure length; and the main seam 28 allows for a user to line up the sleeve for lengthwise placement and removal.

Figure 6:
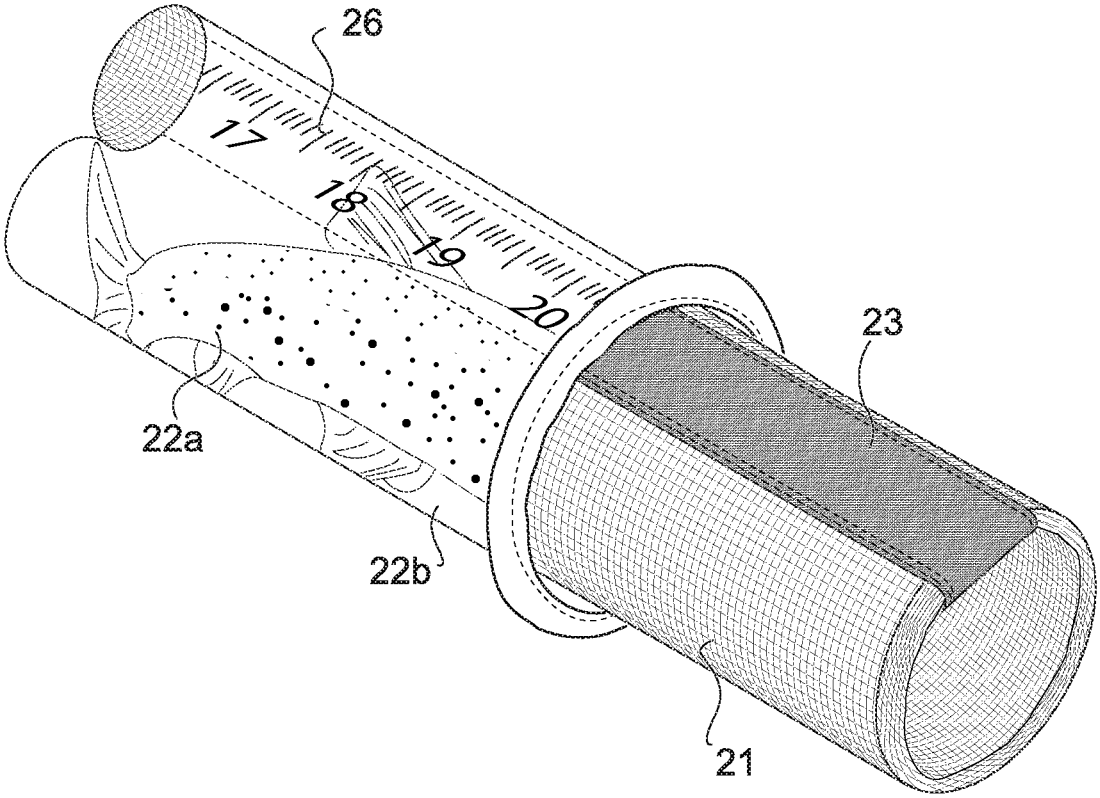
FIG. 6 is an enlarged perspective view of the sleeve of the present invention shown partially turned inside out.

FIG. 6 provides a perspective view of a sleeve 20 turned partially inside out. In a preferred embodiment, oar sleeve 20 is manufactured initially upon a neoprene rubber substrate 21 with a laminated polyester fabric 22*b* on top side so any and all selected designs can be sublimation 22*a* printed. The process comprises the steps of placing tracing paper 22*a* having ink forming an image over the polyester fabric 22*b* and heating the combination, transforming the ink to a gas that permeates fabric pores opening due to the heat applied. When the heat is removed the ink returns to its solid state and is trapped inside the now closed fabric pores.

Figure 7:
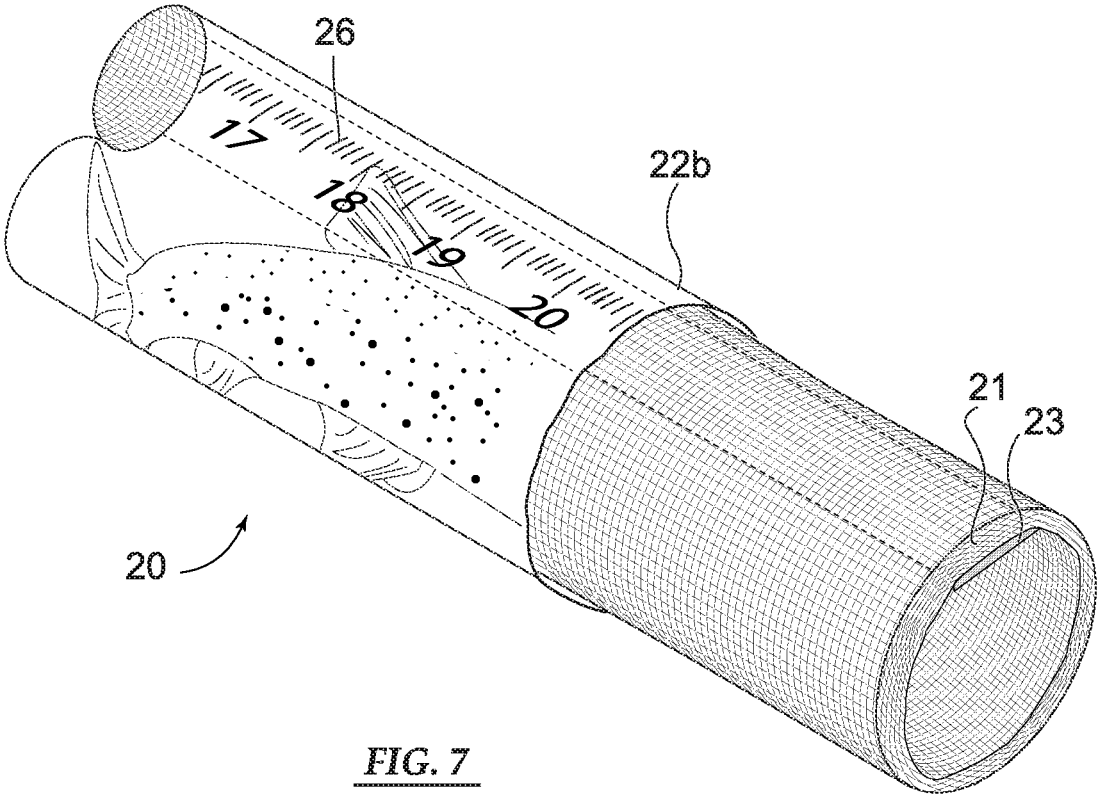
FIG. 7 is a cross-sectional view of the sleeve taken along line 7-7 in FIG. 2.

Also with regard to FIG. 6 and FIG. 7, the sleeve 20 has a neoprene substrate further with an elongated nylon strip having a ¾" width sewn at an inner surface of the neoprene substrate 21 opposite the printed ruler 26, the nylon strip for preventing excessive shrinking or stretching during a manufacturing process, the preventing for ensuring ruler measurement accuracy. It should be noted that in some embodiments the print layer 22 comprises a polyester layer 22*b* combined to a sublimation layer 22*a*; and in other embodiment the print layer 22 comprises a polyester layer 22 with a pre-printed ruler and other designs, artwork, logo or advertising.

Figure 8:
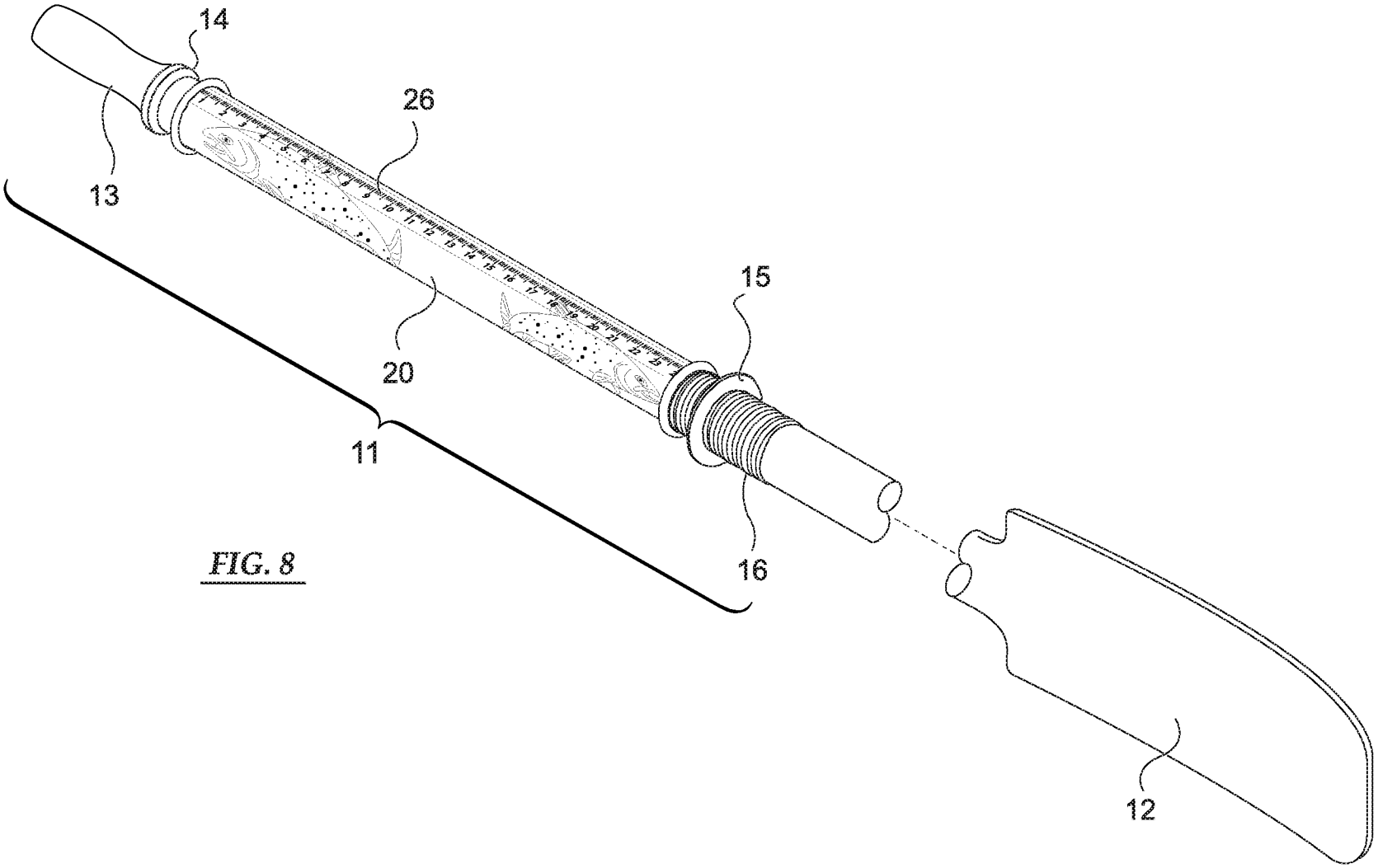
FIG. 8 is a truncated view of a first oar embodiment of the present invention.

With reference to FIG. 8, an additional perspective view of the first embodiment 10 is shown. In the illustration, the ends of the sleeve are rolled up slightly revealing the elongated pole section 11 underneath. More particularly, the sleeve extends from the oar stop 15 all the way to a transition 14 between the handle 13 and the cylindrical pole section 11.

Also with regard to FIG. 8, the oar is configured with an oar stop 15 over a surface of the rope wrap 16 wherein the sleeve 20 is configured extending along the length 11, 12, 13 of the oar 10 from the transition point 14 between the handle 13 and cylindrical pole section 11 to the oar stop 15, the oar stop 15 for preventing the oar 10 from sliding entirely through an oar lock (not shown and configured on a side of a watercraft).

Figure 9:
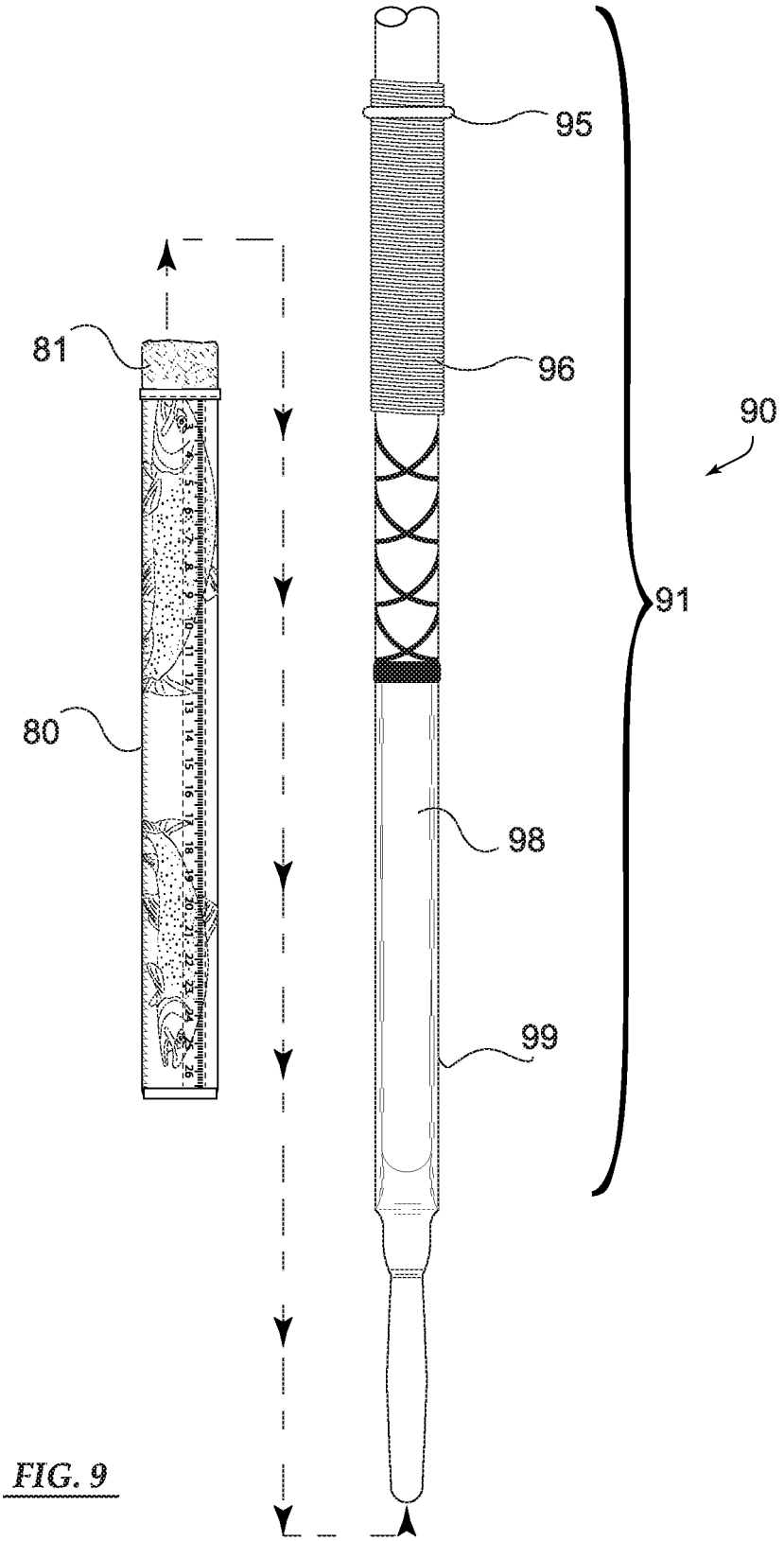
FIG. 9 is an exploded view of a second oar embodiment of the present invention.

FIG. 9 introduces a second embodiment 90 oar combined to a measurement sleeve 80. Typically, the oar 10 has an elongated entirely cylindrical pole section 11 situated between a handle 13 and a blade 12 at proximal and distal ends, respectively. An alternative embodiment (FIG. 9) is applicable to a so called square top oar 90, wherein a substantially cylindrical pole section 91 transitions to an elongated squarish pole 98, 99 as it approaches a handle portion 93. Oar stop 95 and rope wrap 96 are as before 15, 16. And specifically, the pole section transitions to a squarish pole 98 however with rounded ends 99.

Further with regard to FIG. 9, the sleeve itself is different. While the first embodiment utilized so-called shark skin neoprene 21, the second embodiment comprises black duopoly neoprene. The two, 21, 91 are different in that the shark skin neoprene 21 is textured and can grip the cylindrical pole section 11. Conversely, the black duo poly 91 neoprene is smooth as it contacts the cylindrical pole section so it can slide over it easily, as detailed herein. According, the invention comprises textured neoprene 21 in one embodiment wherein the textured is optimum for contacting a cylindrical pole; and secondly the invention in a second embodiment comprises a smooth surface neoprene 81 optimal for contacting, and sliding over a square-top oar.

More specifically with regard to FIG. 9, a sleeve is positioned over a square-top type oar. Initially, an end of the sleeve is folded back about 1 or 2 inches. And, from there the sleeve can be pulled over the square-top oar assisted by the smooth black neoprene 81.

Figure 10:
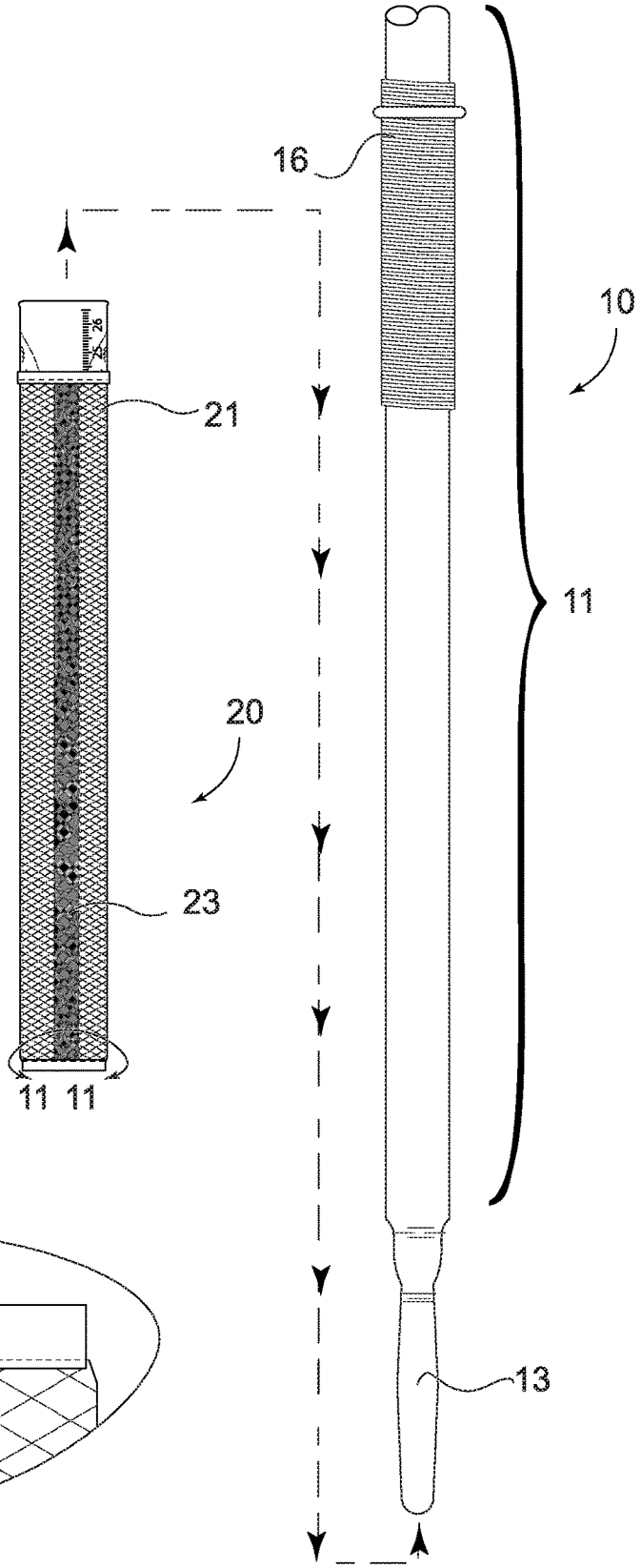
FIG. 10. is an additional exploded view of the first oar embodiment illustration application of the sleeve.

Similarly, with reference to FIG. 10, a textured surface 21 neoprene sleeve 20 is positioned over a standard oar 10. In this embodiment, the sleeve is completely folded inside out and rolled upon the oar. In this manner, the textured neoprene can grip the oar as it's being rolled upon the oar. When removed, the oar can again be rolled and pulled inside out. As FIG. 10 shows the sleeve folded outward, in the positioning technique, the sleeve should be folded inward and rolled.

Figure 11:
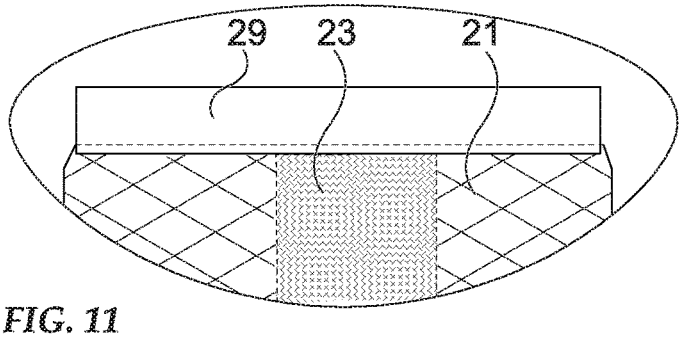
FIG. 11 is an enlarged view of a hemline band taken about circle 11-11 in FIG. 10.

Now turning to FIG. 11, an enlarged view of and end of a sleeve is provided about circle 11-11 in FIG. 10. The illustration features a hemline band 29 assisting in keeping the sleeve in place on an oar; and the hemline band assist in grasping the sleeve for placement and removal; and the hemline band provides a smooth finish to the oar.

Various methods are closely related and within the scope of the novel apparatus inventions herein. For example, the invention is additionally method for determining and verifying a length of a fish comprising the steps of: providing an oar device 90, 91 having a blade 12 on a distal end and a handle 13 on a proximal end; providing a neoprene rubber 21, 81 cylindrical tubular sleeve; affixing a print layer 22 on a top surface of the cylindrical sleeve 20, 21, 80, 81; and marking the print layer with a ruler 26, 86 comprising markings at evenly spaced intervals. As stated, in some embodiments a sublimation layer 22*a* is heated to a polyester layer 22*b* for a predetermined temperature and for a predetermined time, forming the printed layer 22 being permanently combined. The next method step comprises configuring the cylindrical sleeve 20, 80 over the oar device between the blade and the handle; and finally measuring and determining a length of the fish with the ruler.

Other method steps may include: photographing the fish juxtaposed to the sleeve 20,80 configured over the oar device 10, 90; providing a digital photograph thereof; and uploading the digital photograph to a digital medium.

Still further additional method steps include adorning the print layer 22 selecting from a group consisting of: a colorful trout, a fishing guide information, a fishing retail storefront name, and/or fishing equipment brand. An additional method step includes providing an oar stop 15, 95 approximately at an upper mid-section of the oar 10, 90 having a cylindrical pole section 11, 91 (the oar stop 15, 95 for preventing the oar from sliding entirely through an oar lock); and extending the sleeve from approximately the handle 13, 93 to the oar stop 15, 95. Specifically, the sleeve extends from the oar stop to a transition point 14 between a handle pole section and the cylindrical (substantially cylindrical 91, 98, 99) pole section 11.

The method for determining and verifying a length of a fish herein further comprises accounting for a shrinking of the neoprene sleeve 20, 21, 22, 80, 81 during a step of heating by providing a ruler 26, 86 that is larger before the heating, the ruler being accurate subsequent to the heating.

With reference to FIG. 1A and FIG. 9, the invention is an oar 10, 90 for assisting manual propulsion of a water craft which comprises: a handle portion 13. 93 at a proximal end; a blade 12, at a distal end; and a (substantially 91, 98, 99) cylindrical pole section 11, therebetween. The cylindrical pole section 11, 91 includes: a rope wrap 15, 95 approximately at an upper mid-section of the pole section with respect to the proximal end, the rope wrap for interfacing and pivoting about an oar lock affixed to the water craft; and a neoprene sleeve 20, 21, 22, 80, 81 configured partially over the rope wrap between the handle and the oar stop, the neoprene sleeve having a ruler 26, 86 printed on a surface thereof for measuring a length of a fish.

With regard to FIG. 6 and FIG. 7 and more specifically defining the neoprene sleeve 20, 80 that includes: a neoprene substrate 21, 81; and a print layer 22 affixed at an outer surface of the neoprene substrate, the print layer including a sublimation layer 22*a* combined to a polyester layer 22*b* via a heating process, the sublimation layer further comprising a printed image transferred to the polyester layer during said heating process. As an example, the polyester layer 22*b* may be either glued or epoxied to the neoprene substrate 21.

Still further with reference to FIG. 6 and FIG. 7, the neoprene sleeve further comprises an elongated nylon strip 23 having a ¾" width sewn at an inner surface 21, 81 of the sleeve opposite the ruler 26, 86, the nylon strip for preventing excessive shrinking or stretching during a manufacturing process, the preventing for ensuring ruler 26, 86 measurement accuracy.

Regarding FIG. 9, the oar embodiment 90 has a substantially cylindrical pole section 91 transiting to a squarish 98 pole section with rounded corners 99 as the pole section 91 approaches the handle portion 91. And, the neoprene sleeve 80 configured to the square-top oar 90 comprises smooth black duo poly neoprene substrate 81 for assisting in sliding the neoprene sleeve 80 over the squarish pole section in removal or replacing the sleeve.

With reference to FIG. 1B and FIG. 2, an invention embodiment includes an oar measurement sleeve 20 configured to fit over an elongated pole section 11 of an oar 10 that further includes: a neoprene rubber substrate 21 having a length and a circumference; and a print layer 22, combined to the neoprene rubber substrate; the print layer including a ruler having markings at evenly spaced intervals to measure length further wherein the circumference is approximately 6.5 inches, the 6.5 inches being appropriate for snuggly fitting over existing oars being between approximately 8 feet and 10 feet in length.

With reference to FIG. 6 and FIG. 7, the print layer 22 is more specifically defined in that it comprises; a polyester layer 22*b* epoxied to the neoprene substrate 21; and a gaseous sublimation layer 22*a* having solidified subsequent to a heating process. Additionally, regarding the sublimation process, the print layer is provided over a top surface of the neoprene rubber and it is heated at a predetermined temperature and for a predetermined time, for example, 400 degrees Fahrenheit and 20 seconds. Importantly, the invention takes into account a shrinking of the neoprene sleeve as a result of the process. Hence, an accurate and finished measurement ruler 26, 86 will be ½ inches longer before the printing process as the treated neoprene shrink approximately ½ inch in length and ¼ inch in width.

Further regarding the sleeve 20, 80, the full length is sewn with a surge seem 28 and the ends are bordered with a ¾" black hemline binding 29, as is shown in FIG. 11. The finished product is a full bleed, full color printed, with a 26.5" tape measure 26, 86 printed along its 20, 80 full length. The sleeve 20, 80 is outdoor durable and fade resistant. During the sublimation process of the measuring print, the art has to be manipulated due to the neoprene shrinking during the heat transfer. Alternatively, for smaller raft oars, the ruler 26, 86 is 20.5 inches in length.

Yet further regarding position of use, the sleeve is rolled (FIG. 10) on or pulled (FIG. 9) onto the oar 10, 90 from the handle to the oar stop, as detailed herein. The sleeve stretches over the oar and an upper portion of the rope wrap 16, 96, and is held in place naturally by the compression, elasticity and anti-slip (friction) 21 character of the neoprene. The sleeves can be made for different lengths and diameter boat oars with varied measuring lengths. For example, the distant from the oar handle to the oar stop may be 24" for smaller raft oars; in that case the sleeve will be shorter and show a 20.5" tape measure.

As detailed herein and with regard to FIG. 1B and FIG. 2, the invention 10 in a first aspect is an oar comprising: an elongated cylindrical pole section 11; a blade 12 configured at a distal end to cylindrical pole section; a handle 13 configured at a proximal end; and a sleeve 20 configured over the elongated cylindrical pole section 11, the sleeve comprising: a neoprene rubber substrate 21; a print layer 22 combined to the neoprene rubber substrate 21; the print layer including a ruler 26 having marking at evenly spaced intervals to measure length.

Also referring to FIG. 1A, the oar herein is additionally characterized as further comprising: a rope wrap 16 including a cord wrapped around the cylindrical elongated pole section 11 approximately at a mid-section thereof, the rope wrap for contacting and pivoting about an oar lock via an oar stop 15, wherein further the sleeve 20 is configured partially covering a portion of the rope wrap wherein further the sleeve has a portion covering the rope wrap 16 and a portion covering the oar without the rope wrap. It should be appreciated that rope wrap 16 extends equidistant past the oar stop 15 and underneath the sleeve 20, in FIG. 1A.

While the particular Oar Featuring Measurement Sleeve And Related Methods herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. An oar comprising:
- an elongated substantially cylindrical pole section;
- a blade configured at a distal end to the elongated cylindrical pole section;
- a handle configured at a proximal end; and
- a sleeve configured over the elongated cylindrical pole section, the sleeve comprising:
  - a neoprene rubber substrate; and
  - a print layer affixed to the neoprene rubber substrate; the print layer including a ruler having markings at evenly spaced intervals to measure length.

2. The oar of claim 1, further comprising: a rope wrap including a cord wrapped around the cylindrical elongated pole approximately at a an upper mid-section thereof closest to the proximal end, the rope wrap for contacting and pivoting about an oar lock, wherein further the sleeve is configured partially covering a portion of the rope wrap wherein further the sleeve has the portion covering the rope wrap and a portion covering the cylindrical pole section without the rope wrap.

3. The oar of claim 2, further comprising an oar stop configured over a surface of the rope wrap wherein the sleeve is configured extending along the length of the oar from a transition point between the handle and cylindrical pole section to the oar stop, the oar stop for preventing the oar from sliding entirely through an oar lock.

4. The oar of claim 1, the neoprene rubber substrate comprising a textured inner surface for contacting and gripping a surface of the oar during positioning or removal.

5. The oar of claim 1, the neoprene rubber substrate comprising a smooth inner surface for sliding over a surface of the oar during positioning or removal.

6. The oar of claim 1, the sleeve comprising a hemline band configured at first and second ends thereof for contacting and gripping the oar while in a position of use.

7. An oar for assisting manual propulsion of a water craft comprising:

a handle portion at a proximal end;

a blade at a distal end; and a substantially cylindrical pole section, therebetween, the cylindrical pole section comprising:

a rope wrap approximately at an upper mid-section of the pole section with respect to the proximal end, the rope wrap for interfacing and pivoting about an oar lock affixed to the water craft; and a neoprene sleeve configured partially over the rope wrap between the handle and the oar stop, the neoprene sleeve having a ruler printed on a surface thereof for measuring a length of a fish.

8. The oar for assisting manual propulsion of a water craft of claim 7, the neoprene sleeve further comprising:

a neoprene substrate; and a print layer affixed at an outer surface of the neoprene substrate, the print layer including a sublimation layer combined to a polyester layer via a heating process, the sublimation layer further comprising a printed image transferred to the polyester layer during said heating process.

9. The oar for assisting manual propulsion of a water craft of claim 7, the neoprene sleeve further comprising an elongated nylon strip sewn at an inner surface of the sleeve opposite the ruler, the nylon strip for preventing excessive shrinking or stretching during a manufacturing process, the preventing for ensuring ruler measurement accuracy.

10. The oar for assisting manual propulsion of a water craft of claim 7, the substantially cylindrical pole section transiting to a squarish pole section with rounded corners as the pole section approaches the handle portion, the neoprene sleeve comprising smooth neoprene for assisting in sliding the neoprene sleeve over the squarish pole section in removal or replacing the sleeve.

11. An oar measurement sleeve configured to fit over an elongated pole section of the oar comprising:

a neoprene rubber substrate having a length and a circumference; and a print layer heated to the neoprene rubber substrate; the print layer including a ruler having markings at evenly spaced intervals to measure length further wherein the circumference is approximately 6.5 inches, the 6.5 inches being appropriate for snuggly fitting over existing oars being between approximately 8 feet and 10 feet in length.

12. The oar measurement sleeve configured to fit over an elongated pole of claim 11, the print layer comprising:

a polyester layer epoxied to the neoprene substrate; and a gaseous sublimation layer having solidified subsequent to a heating process.

13. The oar measurement sleeve configured to fit over an elongated pole of claim 11, a main seam along a length thereof, the main seam assisting in placing the sleeve aligned to the oar.

* * * * *